United States Patent [19]

Hatagishi

[11] Patent Number: 5,037,319

[45] Date of Patent: Aug. 6, 1991

[54] CONNECTOR WITH SLIDE COVER

[75] Inventor: Yuji Hatagishi, Shizuoka, Japan

[73] Assignee: Yazaki Corporation, Tokyo, Japan

[21] Appl. No.: 520,917

[22] Filed: May 9, 1990

[30] Foreign Application Priority Data

May 15, 1989 [JP] Japan ..... 1-54444[U]

[51] Int. Cl.[5] ..... H01R 13/453

[52] U.S. Cl. ..... 439/140; 439/137; 439/718

[58] Field of Search ..... 439/140, 141, 135, 136, 439/145, 137, 149, 718

[56] References Cited

U.S. PATENT DOCUMENTS

| | | | |
|---|---|---|---|
| 3,836,826 | 9/1974 | Hotchkiss et al. | 439/718 |
| 4,017,137 | 4/1977 | Parks | 439/135 |
| 4,417,781 | 11/1983 | Johnston et al. | 439/718 |
| 4,796,289 | 1/1989 | Masor | 439/718 |
| 4,857,004 | 8/1989 | Poirier | 439/140 |
| 4,868,714 | 9/1989 | Banjo et al. | 439/140 |
| 4,940,430 | 7/1990 | Fujitani et al. | 439/136 |

FOREIGN PATENT DOCUMENTS

| | | | |
|---|---|---|---|
| 57-10470 | 3/1982 | Japan | 439/140 |
| 1243712 | 8/1971 | United Kingdom | 439/136 |

*Primary Examiner*—Larry I. Schwartz
*Assistant Examiner*—Kevin J. Carroll
*Attorney, Agent, or Firm*—Sughrue, Mion, Zinn, Macpeak & Seas

[57] ABSTRACT

A connector with a slide cover includes a connector housing. An upper side of a connector housing is completely removed to open terminal-receiving chambers of the connector housing. A cover is slidably mounted on the connector housing so as to cover electrical contact portions of terminals received respectively in the terminal-receiving chambers.

5 Claims, 4 Drawing Sheets

CONNECTOR WITH SLIDE COVER

BACKGROUND OF THE INVENTION

This invention relates to a connector having a slide cover which opens terminal-receiving chambers to allow electrical contact portions of terminals to make electrical contact with their respective mating terminals.

FIG. 7 is a perspective view of a conventional connector with a slide cover, and FIG. 8 is a vertical cross-sectional view of the connector in its connected condition.

The connector 27 with the slide cover is adapted to be connected to its mating connector 28. In the connector 27 with the slide cover, a front-half of a front wall of a connector housing 29 is notched or removed to form an opening 32 by which terminal-receiving chambers 31 are open. A resilient contact portion 34 of each terminal 33 is exposed at the opening 32. A pair of lip-like guide groove portions 35 are formed respectively on the opposite side portions of the connector housing 29 in a projected manner, and a cover 36 of the slide type is received in the guide groove portions 35. Retainer projections 37 are formed on the front end portion of the cover 36, and are engageable respectively in notches 39 formed in a beam 38 interconnecting the two guide groove portions 35.

In the mating connector 28, a flexible board 41 having a printed circuit 40 is mounted in a connector-fitting chamber 42. As shown in FIG. 8, when the connector 27 with the slide cover is fitted in the mating connector 28, the front end of the cover 36 is brought into contact with the upper edge of the mating connector 28, so that the cover 36 slides upward so as to expose the resilient contact portions 34 of the terminals 33. As a result, the resilient contact portions 34 make electrical contact with the printed circuit 40.

However, in the above conventional connector 27 with the slide cover, the guide groove portions 35 for guiding the sliding movement of the cover 36 must be provided at the front side of the connector housing 29 in a projected manner. This is disadvantageous in that the connector 27 is complicated in configuration and is bulky in size. Further, to assemble connector 27 an electric wire 43 is beforehand clamped to the terminal 33, and then the terminal 33 is inserted into the terminal-receiving chamber 31, and then the cover 36 is attached to the guide groove portions 35. A problem with the conventional connector is that these assembly operations must be done manually, keeping the productivity of connector assembly low.

SUMMARY OF THE INVENTION

With the above deficiencies of the prior art in view, it is an object of this invention to provide a connector with a slide cover which is compact in construction and can improve the productivity.

According to the present invention, there is provided a connector with a slide cover characterized in that an upper side of a connector housing is completely removed to open terminal-receiving chambers; and a cover is slidably mounted on the connector housing so as to cover electrical contact portions of terminals received in the terminal-receiving chambers.

Guide projections can be formed on side walls of the connector housing, the cover having arms engageable with the guide projections.

Instead of an upper wall of the connector housing, the slidable cover is provided, and therefore the connector can be of a compact construction. Further, each terminal is introduced into the open terminal-receiving chamber from the upper side, and the arms of the cover are brought into engagement with the guide projections of the connector housing from the upper side. Therefore, the assembly can be effected automatically.

DESCRIPTION OF THE PREFERRED EMBODIMENT OF THE INVENTION

Figure 1:
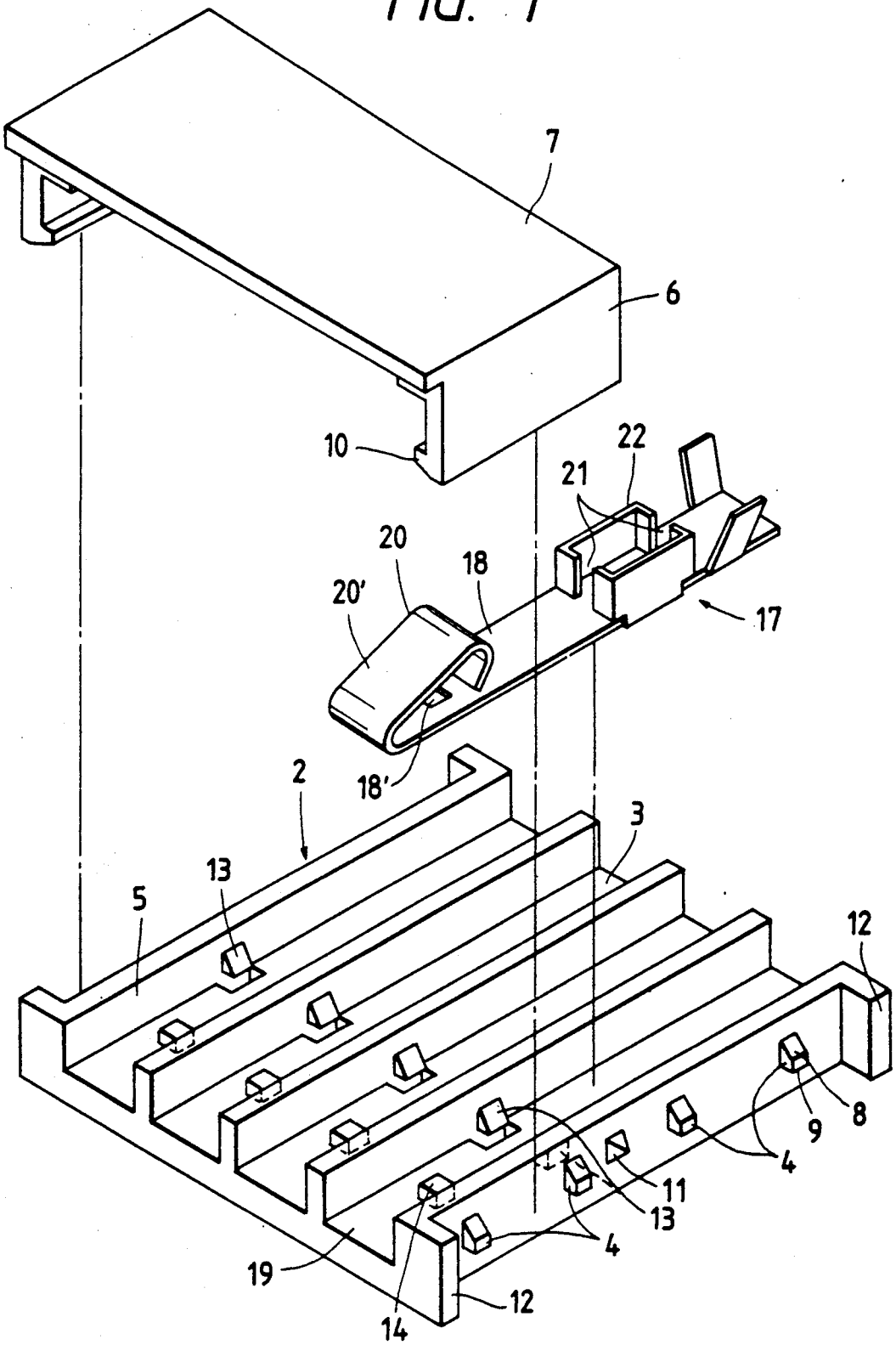
FIG. 1 is an exploded perspective view of a connector provided in accordance with the prevent invention.
Figure 2:
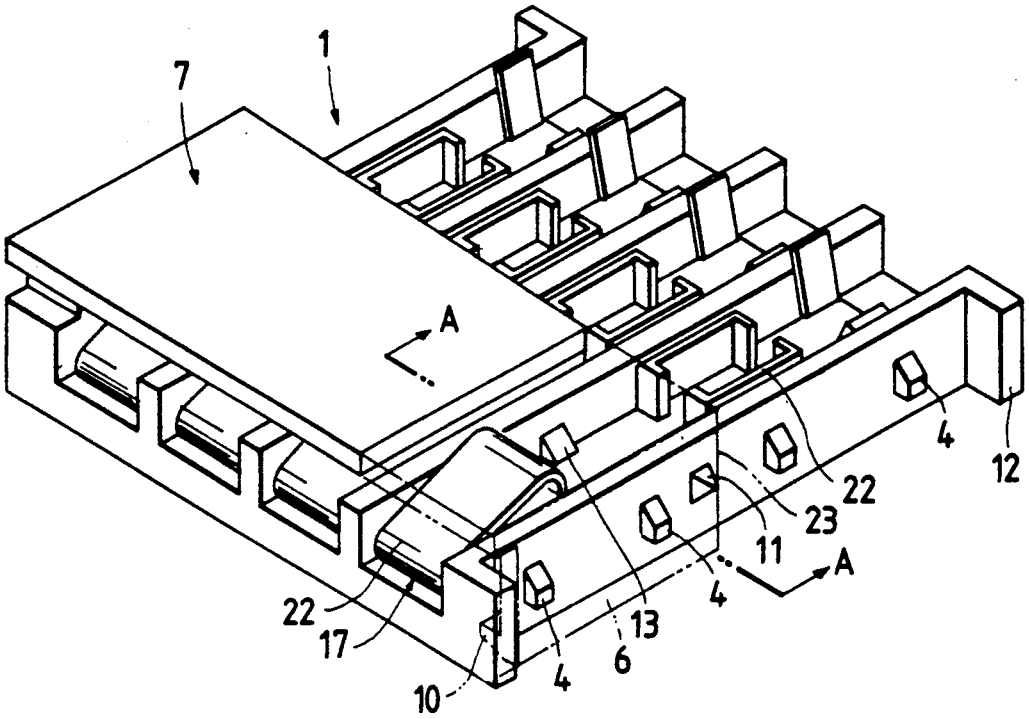
FIG. 2 is a perspective view of the connector in its assembled condition.

FIG. 1 is an exploded perspective view of a connector with a slide cover provided in accordance with the present invention, and FIG. 2 is a perspective view of the connector in its assembled condition.

The connector 1 with the slide cover comprises a connector housing 2 made of a synthetic resin. An opening 5 to in the connector housing 2 exposes terminal-receiving chambers 3 to the exterior. A plurality of (four in the drawings) guide projections 4 are formed on each of opposite side walls of the connector housing 2, the guide projections 4 being spaced from one another longitudinally, that is, along the length of the side wall of the connector housing 2. A slidable cover 7 of a synthetic resin is attached to the connector housing 2 to cover the opening 5. The cover 7 has a pair of arms 6 depending respectively from the opposite sides of the cover 7. The arms 6 can move over the guide projections 4 and is slidable longitudinally.

Each guide projection 4 has an upper inclined surface 8 and a lower horizontal surface 9. An inwardly-directed pawl 10 is formed on the distal end of each arm 6. The pawl 10 can move or slide over the upper inclined surface 8 of each guide projection 4 so as to be brought into sliding contact with lower horizontal surface 9 of the guide projection 4, so that the cover 7 can slide longitudinally. A projection 11 for provisionally stopping the cover is formed on each of the side walls of the connector housing 2, the projection 11 being disposed between the two central guide projections 4. A pair of stoppers 12 for stopping the cover 7 are formed respectively at the opposite ends of each of the side walls of the connector housing 2.

Figure 3:
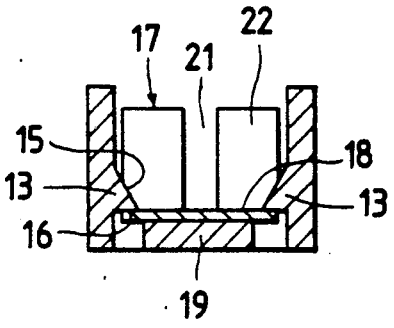
FIG. 3 is a cross-sectional view taken along the line A—A of FIG. 2.

Terminal-fitting projections 13 are formed respectively on opposite side walls of each terminal-receiving chamber 3 adjacent to a bottom wall 19 thereof, and a retainer projection 14 for limiting the longitudinal movement of a terminal 17 is formed on the bottom wall 19. As shown in FIG. 3 which is a cross-sectional view taken along the line A—A of FIG. 2, the terminal-fitting projection 13 has an upper inclined surface 15 and a lower horizontal surface 16. A base plate portion 18 of the terminal 17 can move over the upper inclined surface 15 so as to be fitted in between the lower horizontal surface 16 and the bottom wall 19.

The terminal 17 has a resilient contact portion 20 at its front end portion, and has a pair of opposed upstanding clamp plates 22 intermediate the opposite ends thereof. Each of the clamp plates 22 has an electric wire-clamping slot 21. Because of the resilient nature of the resilient contact portion 20, an electrical contact surface 20' of the resilient contact portion 20 is projected outwardly from the terminal-receiving chamber 3 through the opening 5 when the resilient contact portion 20 is not covered by the cover 7. A retainer hole 18' for cooperating with the retainer projection 14 of the connector housing 2 is formed through the base plate portion 18 of the terminal 17. The engagement of the retainer projection 14 in the retainer hole 18, prevents a rearward withdrawal of the terminal 17.

Figure 4:
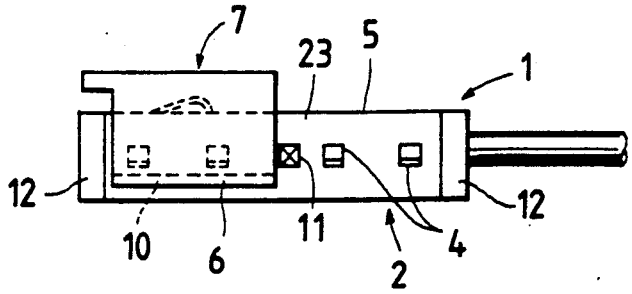
FIG. 4 is a side-elevational view of the connector shown in FIG. 2.

FIGS. 2 and 4 show the condition in which the cover 7 is attached to the connector housing 2. Since the proximal end 23 of the cover 7 is abutted against the cover provisional-stop projections 11 of the connector housing 2, the cover 7 remains stationary, for example, during the transport of the connector 1, thereby protecting the resilient contact portions 20 of the terminals 17.

Figure 5:
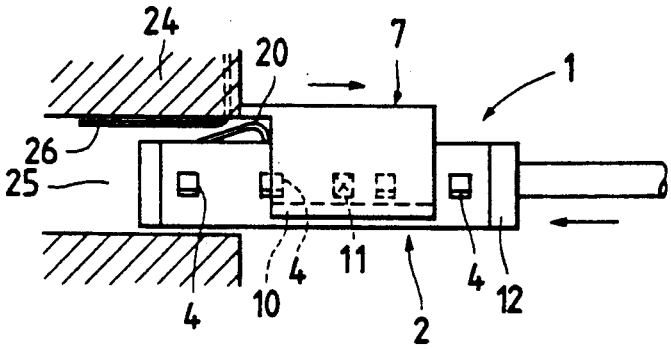
FIG. 5 is a side-elevational view of the connector in its connected condition.

As shown in FIG. 5, when the connector 1 with the slide cover is inserted into a connector-fitting chamber 25 of a mating connector 24, the front end of the cover 7 is brought into contact with the edge of an inlet of the mating connector 24, so that the cover 7 moves over the provisional stop projections 11 and slide toward the electric wire-connecting side, with the pawls 10 of the arms 6 held in contact with the guide projections 4 of the connector housing 2.

Figure 6:
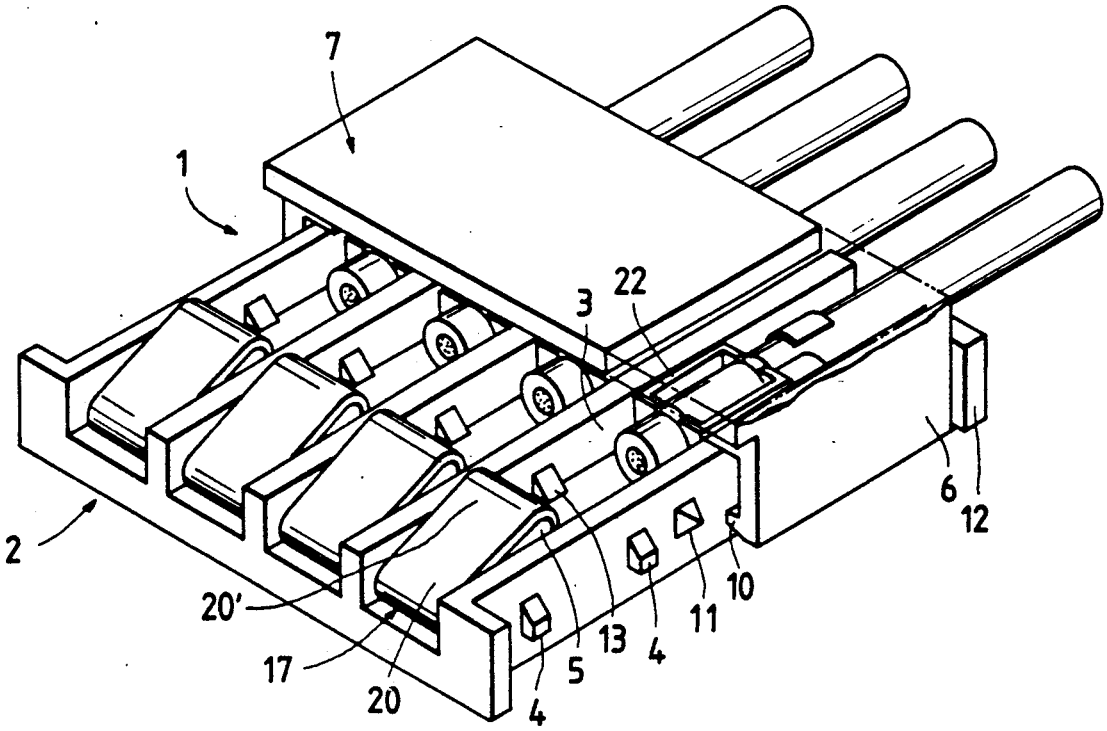
FIG. 6 is a perspective view of the connector in its connected condition.
Figure 7:
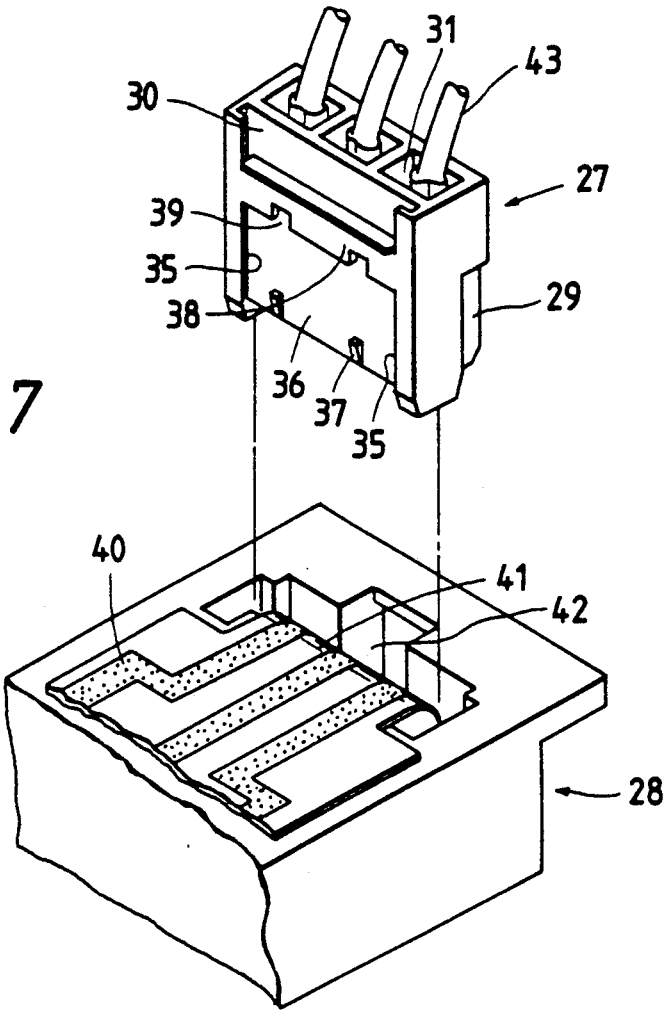
FIG. 7 is a perspective view of a conventional connector.
Figure 8:
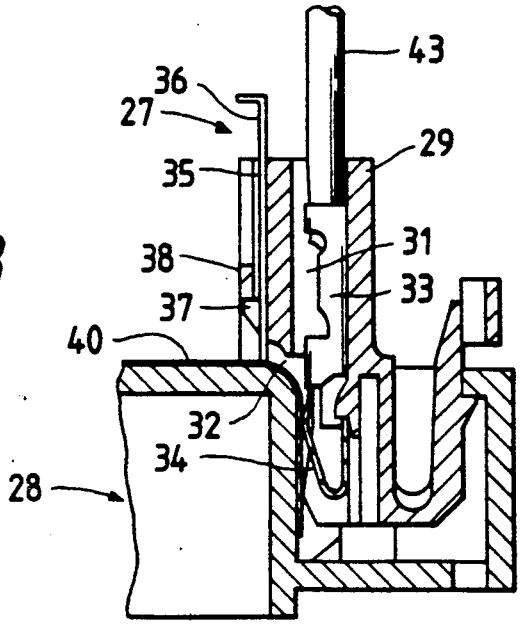
FIG. 8 is a vertical cross-sectional view of the conventional connector of FIG. 7 in its connected condition.

FIG. 6 is a perspective view showing this condition. The cover 7 protects the clamp plates 22 of the terminal 17 from the exterior. Because of the resilient nature of the resilient contact portion 20, the electrical contact surface 20' of the resilient contact portion 20 is projected outwardly from the terminal-receiving chamber 3 through the opening 5 to make electrical contact with a mating contact portion 26 (see FIG. 5).

As described above, in the present invention, instead of an upper wall of the connector housing, the slidable cover is provided, and therefore the connector can be of a compact construction. Further, each terminal is introduced into the terminal-receiving chamber of the connector housing from the upper side, and the electric wire is clamped to the terminal from the upper side, and the cover is attached to the connector housing from the upper side. Therefore, the assembly can be effected by an automation apparatus, which improves the productivity.

What is claimed is:

1. A connector for making electrical contact with a mating connector and adapted to receive at least one terminal, said at least one terminal having an electrical contact portion at one end and a wire clamp at the other end for an electric wire, said connector comprising a connector housing completely open upwardly and a mating slide cover for defining terminal-receiving chambers having first and second portions, wherein aid slide cover is slidably mounted in a first position over only said first portions so as to cover said electrical contact portion of each terminal received respectively in said terminal-receiving chambers such that, when said connector is inserted into said mating connector said slide cover slides towards a second position over only said second portions to expose said electrical contact portions to said mating connector.

2. The connector according to claim 1, further comprising guide projections formed on side walls of said connector housing, said slide cover having arms engageable with said guide projections.

3. The connector according to claim 2, further comprising a stop means for retaining said slide cover at a predetermined position on said side walls of said connector housing.

4. The connector according to claim 3, wherein each of said guide projections has an upper slant surface and each of said arms has an inwardly projecting pawl, thereby to allow said pawls to be readily engageable with the guide projections.

5. The connector according to claim 3, wherein said guide projections are provided in two sets, a first set corresponding to said first portions, and a second set corresponding to said second portions, said stop means being disposed between said first and second sets.

* * * * *